US007893900B2

(12) United States Patent
Kim et al.

(10) Patent No.: US 7,893,900 B2
(45) Date of Patent: Feb. 22, 2011

(54) LIQUID CRYSTAL DISPLAY DEVICE AND METHOD OF DRIVING THE SAME

(75) Inventors: Seok-Su Kim, Gumi-si (KR); Sun-Young Choi, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1032 days.

(21) Appl. No.: 11/648,356

(22) Filed: Dec. 28, 2006

(65) Prior Publication Data

US 2008/0001891 A1 Jan. 3, 2008

(30) Foreign Application Priority Data

Jun. 30, 2006 (KR) ..... 10-2006-0060772

(51) Int. Cl.
*G09G 5/00* (2006.01)

(52) U.S. Cl. ..... 345/87; 345/98; 345/100; 345/204

(58) Field of Classification Search ..... 345/87–100, 345/204, 690, 50–54, 211–213
See application file for complete search history.

(56) References Cited

U.S. PATENT DOCUMENTS 5,818,402 A * 10/1998 Park et al. ..... 345/58
5,841,410 A * 11/1998 Oda et al. ..... 345/58
6,466,191 B1 * 10/2002 Choi et al. ..... 345/94
2002/0053999 A1 5/2002 Chou
2004/0189575 A1 * 9/2004 Choi et al. ..... 345/96
2006/0050042 A1 * 3/2006 Yi ..... 345/98

FOREIGN PATENT DOCUMENTS

JP 2005-215591 8/2005
JP 2005-215591 A 8/2005

OTHER PUBLICATIONS

Search Report dated Apr. 11, 2007 for corresponding Great Britain Patent Application No. GB0624953.6.
Office Action dated Apr. 11, 2007 for corresponding Great Britain Patent Application No. GB0624953.6.

* cited by examiner

*Primary Examiner*—Quan-Zhen Wang
*Assistant Examiner*—Jennifer T Nguyen
(74) *Attorney, Agent, or Firm*—Brinks Hofer Gilson & Lione

(57) ABSTRACT

A liquid crystal display device includes a liquid crystal panel, including multiple pixels, and a driving circuit. The pixels are driven according to a first driving pattern. The driving circuit monitors the liquid crystal panel for a cross-talk condition. The driving circuit generates a signal and changes the driving pattern to an alternate driving pattern when a cross-talk condition is detected in the liquid crystal panel.

11 Claims, 6 Drawing Sheets

LIQUID CRYSTAL DISPLAY DEVICE AND METHOD OF DRIVING THE SAME

BACKGROUND

1. Priority Claim

This application claims the benefit of priority from Korean Patent Application No. 2006-0060772, filed on Jun. 30, 2006, which is incorporated by reference.

2. Technical Field

The present invention relates to a liquid crystal display device.

3. Related Art

Some display devices use cathode-ray tubes (CRTs). Other display devices may be flat panel displays, such as liquid crystal display (LCD) devices, plasma display panels (PDPs), field emission displays (FED), and electro-luminescence displays (ELDs). Some of these flat panel displays may be driven by an active matrix driving method in which a plurality of pixels arranged in a matrix configuration are driven using a plurality of thin film transistors. Among these active matrix type flat panel displays, liquid crystal display (LCD) devices and electroluminescent display (ELD) devices may exhibits a higher resolution, and increased ability to display colors and moving images as compared to some of the other flat panel display devices.

A LCD device may include two substrates that are spaced apart and face each other with a layer of liquid crystal molecules interposed between the two substrates. The two substrates may include electrodes that face each other. A voltage applied between the electrodes may induce an electric field across the layer of liquid crystal molecules. The alignment of the liquid crystal molecules may be changed based on an intensity of the induced electric field, thereby changing the light transmissivity of the LCD device. Thus, the LCD device may display images by varying the intensity of the electric field across the layer of liquid crystal molecules.

FIG. 1 is a block diagram of a LCD device according to the related art. FIG. 2 is a circuit diagram of a liquid crystal panel of FIG. 1. In FIG. 1, the LCD device includes a liquid crystal panel 2 and a driving circuit 4. The driving circuit 4 may include a gate and data driver 20 and 18, a timing controller 12, and a gamma reference voltage generator 16.

In FIG. 2, the liquid crystal panel 2 includes a plurality of gate lines GL1 to GLn along a first direction and a plurality of data lines DL1 to DLm along a second direction. The first direction may be horizontal and the second direction may be vertical. A plurality of common lines CL1 to CLn are spaced apart from, and may be generally parallel to, the plurality of gate lines GL1 to GLn.

The plurality of gate lines GL1 to GLn and the plurality of data lines DL1 to DLm cross each other to define a plurality of pixels P. Each pixel P includes a thin film transistor TFT and a liquid crystal capacitor LC. The liquid crystal capacitor LC includes a pixel electrode connected to the thin film transistor TFT, a common electrode, and a liquid crystal layer between the pixel and common electrodes. The common electrode is connected to the corresponding common line CL1 to CLn and supplied with a common voltage through the corresponding common line CL1 to CLn. The pixel and common electrodes are disposed on the same substrate to produce an in-plane electric field. The LCD device operated by the in-plane electric field is referred to as an IPS (in-plane switching) mode LCD.

In FIG. 1, an interface 10 is supplied with data signals and control signals such as a vertical synchronization signal, a horizontal synchronization signal, a data enable signal, and a data clock signal. The data signals and control signals are supplied from an external system, such as a computer system.

In FIG. 1, the timing controller 12 is supplied with the control signals from the interface 10 and generates control signals to control the gate and data drivers 20 and 18. The timing controller 12 processes data signals and supplies those to the data driver 18. The gate driver 20 is supplied with the control signals from the timing controller 12 to sequentially output gate voltages to the gate lines GL1 to GLn. The gate lines GL1 to GLn are sequentially enabled, and the thin film transistors TFT connected to the enabled gate line GL1 to GLn are turned on. The data driver 18 is supplied with the data signals and the control signals from the timing controller 12. The data driver 18 outputs data voltages to the data lines DL1 to DLm when the gate line GL1 to GLn is enabled. A gamma reference voltage generator 16 generates gamma reference voltages which are supplied to the data driver 18. A power supply 14 supplies voltages that operate the components of the LCD device. The power supply 14 also supplies a common voltage to the common electrode of the liquid crystal panel 2.

A dot inversion driving method may be used to operate the LCD device. In a dot inversion driving method the polarity of a pixel P may be changed between positive and negative values. In one type of dot inversion driving method, horizontal two-dot inversion driving, a first pixel is driven with either a positive or negative polarity and subsequent groups of two adjacent pixels are driven with alternating polarities. When some LCD devices are operated with the horizontal two-dot inversion driving method a cross-talk (or a smear) may occur and degrade the performance of the LCD device.

FIGS. 3 and 4 are diagrams of polarity arrangements of pixels that produce and do not produce a cross-talk, respectively, in an LCD device operated with a horizontal two-dot inversion driving method according to the related art.

In FIGS. 3 and 4, a first pixel is driven with a positive or negative polarity and subsequent groups of two adjacent pixels are driven with alternating polarities. When an image having a vertical stripe pattern of two white lines and two black lines is displayed, a polarity arrangement of FIG. 3 produces a cross-talk in a gray display region GR. However, when a polarity arrangement of FIG. 4 is used a cross-talk is not produced in a gray display region GR. Whether or not cross-talk is produced may depend on the uniformity of polarity within a white display region (WH) and a black display region (BL).

In an $n^{th}$ horizontal line of FIG. 3, there are more pixels in a white display region WH, having negative polarities (−) than positive polarities (+). Also in the $n^{th}$ horizontal line of FIG. 3, there are more pixels in a black display region BL, having positive polarities (+) than negative polarities (−). That is, in each of the white and black display regions WH and BL, the polarities of the pixels are non-uniform. For a next frame, in the $n^{th}$ horizontal line, the non-uniformity of the pixel polarities also exists. The data voltages for the white display region WH may have the greatest amplitude with respect to a common voltage Vcom of an $n^{th}$ common line, while the data voltages for a black display region BL may have the smallest amplitude. The data voltages for a gray display region GR may have an amplitude that is between the amplitudes of the white and black display regions WH and BL. The amplitude of the gray display region GR may be mid-way between the white and black display regions WH and BL. Because the data lines are coupled with the $n^{th}$ common line, the data voltages for the pixels along the $n^{th}$ horizontal line are reflected on the $n^{th}$ common line and have an effect on the common voltage of the $n^{th}$ common line. The non-uniformity of the polarity in each of the white and black display regions WH and BL causes the common voltage Vcom of the common lines to shift. In FIG. 3, the data voltages in the white display region WH have the greatest amplitude and as a result of the excess negative polarities, the common voltage Vcom of the $n^{th}$ common line is shifted toward a lower level. Since the $(n+1)^{th}$ horizontal line has an excess of positive polarities in the white display region, and the data voltages of the white display region WH have the greatest amplitude, the common voltage Vcom of a $(n+1)^{th}$ common line is shifted toward a higher level. As a result, a common voltage Vcom along a vertical direction may be alternately shifted. In other words, the common voltage Vcom along a vertical direction may have a ripple, as shown in FIG. 3.

In an $n^{th}$ horizontal line of FIG. 4, there are an equal number of positive polarity (+) pixels and negative polarity (−) pixels in a white display region WH. Similarly, in a black display region BL, there are also an equal number of positive polarity (+) pixels and negative polarity (−) pixels. In each of the white and black display regions WH and BL of FIG. 4, the polarities of the pixels are uniform. For a next frame, in the $n^{th}$ horizontal line, the uniformity of the pixels also exists. Coupling between the data lines and the common lines is minimized by the uniform polarity. Accordingly, a common voltage Vcom may have little or no ripple, as shown in FIG. 4.

The common voltage ripple may be present in LCD devices using LOG (line on glass) lines to achieve a COG (chip on glass) technology as well as other types of LCD devices. Additionally, the common voltage ripple may be present in a large-sized LCD devices. Further, the gate voltage of a LCD device may produce a voltage ripple which may cause a cross-talk in a gray display region GR of a LCD device. Therefore, a need exists for an improved LCD device.

SUMMARY

A liquid crystal display device includes a liquid crystal panel, including multiple pixels, and a driving circuit. The pixels are driven according to a first driving pattern. The driving circuit monitors the liquid crystal panel for a cross-talk condition. The driving circuit generates a signal and changes the driving pattern to an alternate driving pattern when a cross-talk condition is detected in the liquid crystal panel.

Other apparatuses, methods, features and advantages will be or will become apparent to one with skill in the art upon examination of the following figures and detailed description. It is intended that all such additional apparatuses, methods, features and advantages be included within this description, be within the scope of the invention, and be protected by the following claims.

BRIEF DESCRIPTION OF THE DRAWINGS

The application may be better understood with reference to the following drawings and description. The components in the figures are not necessarily to scale, emphasis instead being placed upon illustrating the principles of the invention.

DETAILED DESCRIPTION

Figure 1:
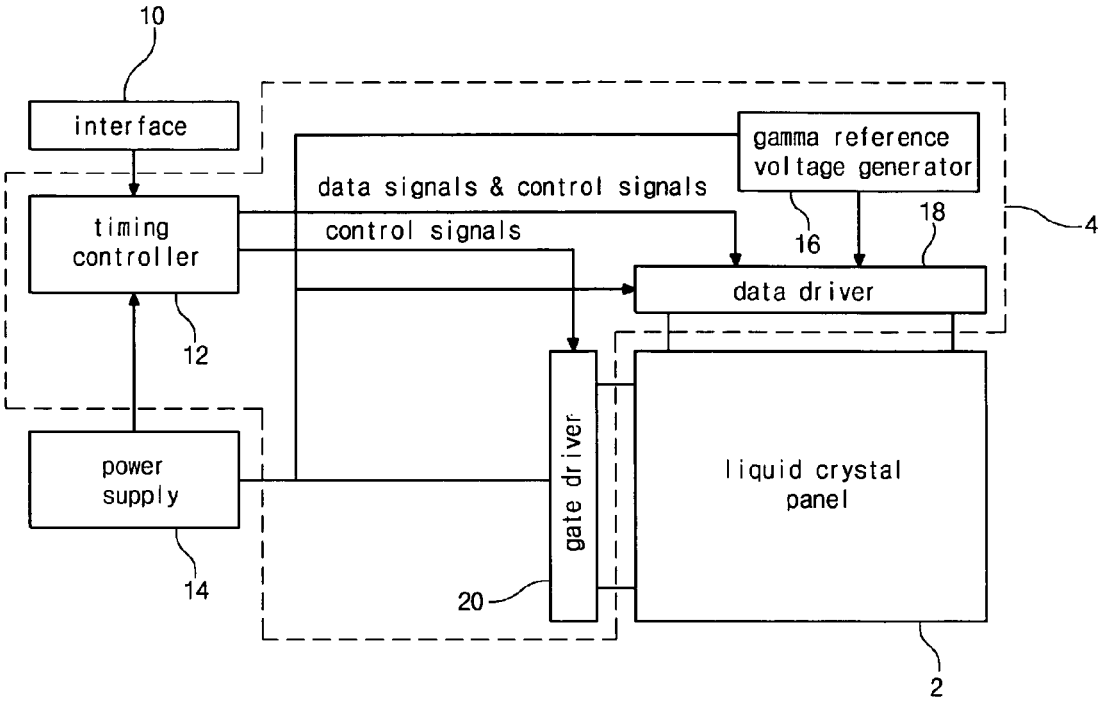
FIG. 1 RELATED ART
FIG. 1 is a block diagram of a LCD device according to the related art.
Figure 2:
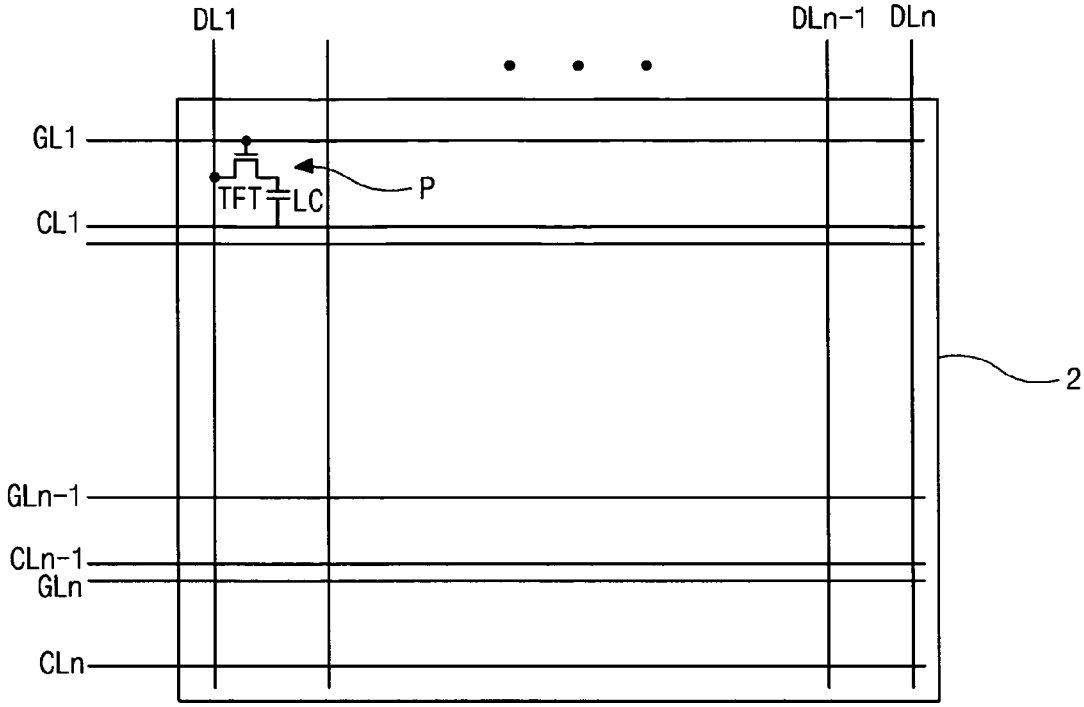
FIG. 2 RELATED ART
FIG. 2 is a circuit diagram of a liquid crystal panel of FIG. 1.
Figure 3:
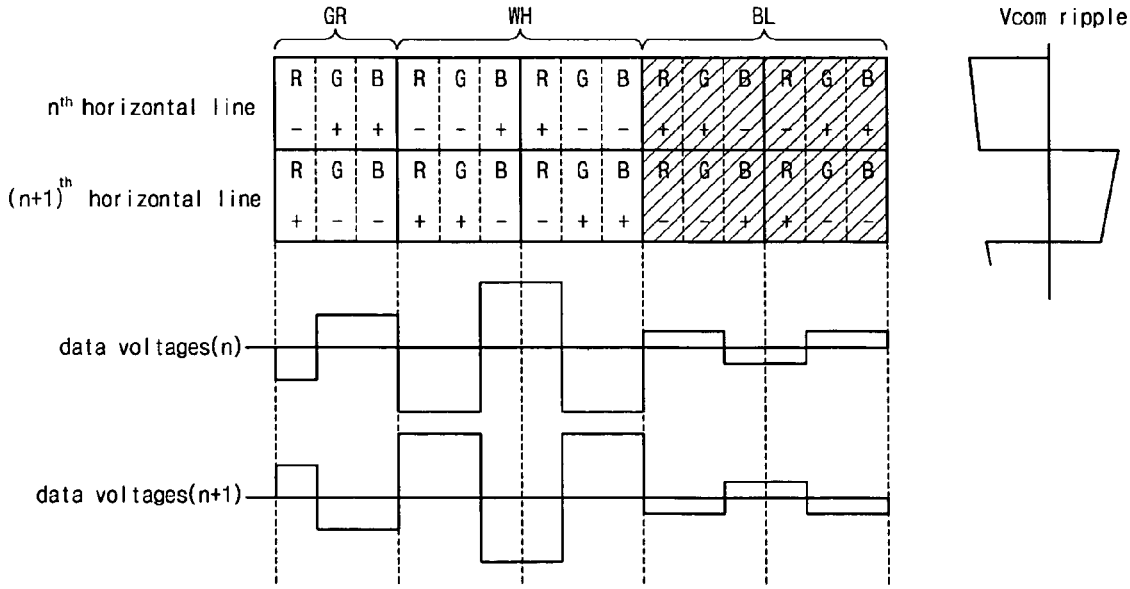
FIG. 3 RELATED ART
FIGS. 3 and 4 are diagrams of polarity arrangements of pixels producing and not producing a cross-talk in a LCD device according to the related art.
Figure 4:
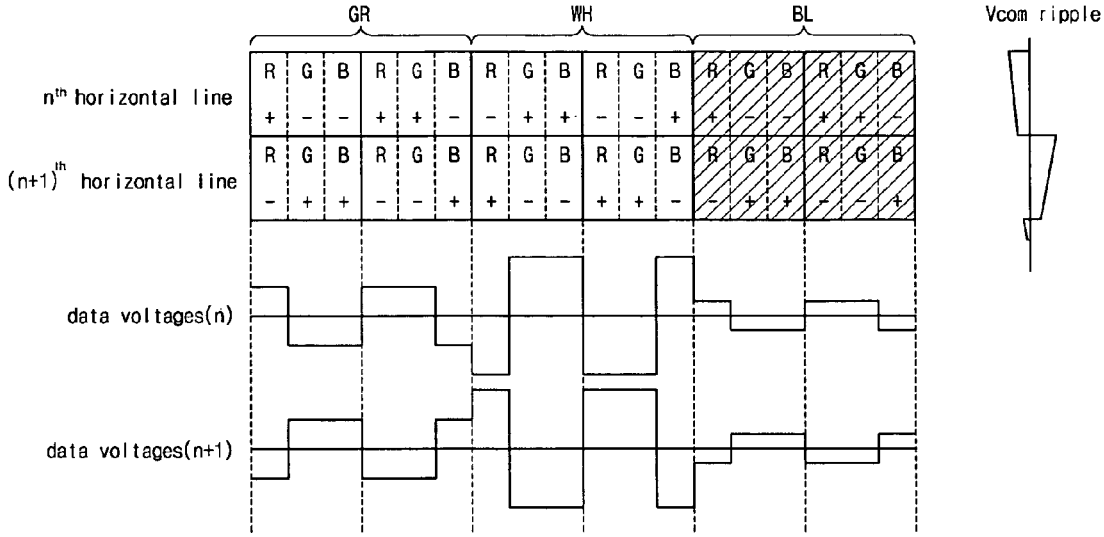
FIG. 4 RELATED ART
Figure 5:
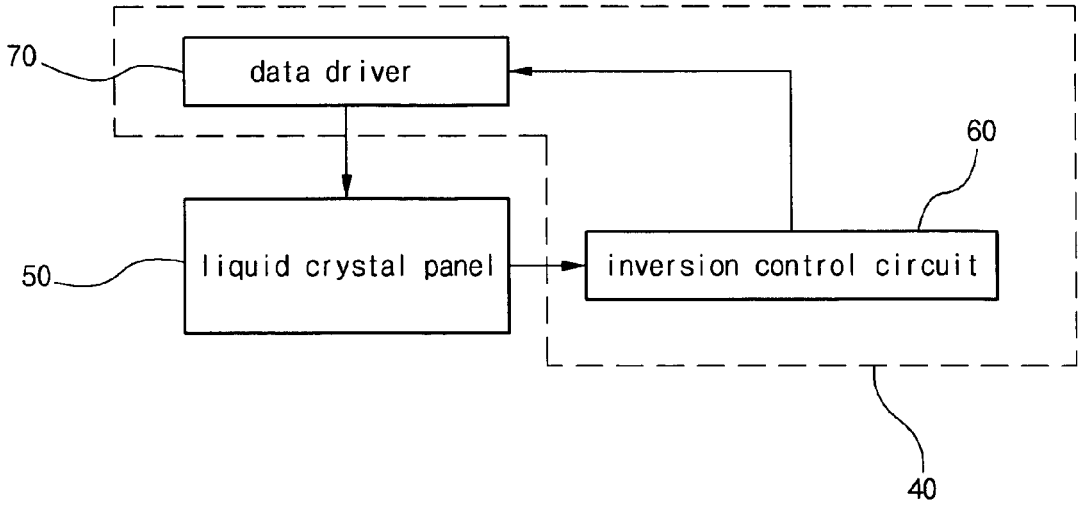
FIG. 5 is a block diagram of a LCD device.

FIG. 5 is a block diagram of a LCD device. In FIG. 5, the LCD device includes a liquid crystal panel 50 and a driving circuit 40. The driving circuit 40 may include a data driver 70 and an inversion control circuit 60. The driving circuit 40 may further include a timing controller, a gate driver, and a gamma reference generator. The LCD device may also include an interface and a power supply.

An interface may be supplied with data signals and control signals such as a vertical synchronization signal, a horizontal synchronization signal, a data enable signal, and a data clock signal. The data signals and control signals may be supplied from an external system, such as a computer system. A timing controller may be supplied with the control signals from the interface and may generate control signals to control the gate and/or data drivers. The timing controller may process data signals and may supply those data signals to the data driver. The gate driver may be supplied with the control signals from the timing controller and may sequentially output gate voltages that are supplied to the liquid crystal panel 50. The data driver may be supplied with the data signals and the control signals from the timing controller. The data driver may output data voltages to the liquid crystal panel 50. A gamma reference voltage generator may generate gamma reference voltages which may be supplied to the data driver.

The liquid crystal panel 50 includes a plurality of pixels that may display red (R), green (G), and blue (B). The liquid crystal panel 50 may include a plurality of gate lines, data lines, and common lines. The plurality of pixels may be defined by the crossing of the gate lines and the data lines. Each pixel may include a thin film transistor and a liquid crystal capacitor. The liquid crystal capacitor may include a pixel electrode connected to the thin film transistor, a common electrode connected to the corresponding common line and a liquid crystal layer between the pixel and common electrodes. The pixel and common electrodes may produce an in-plane electric field. The polarity of a pixel may be controlled on a frame and/or horizontal line basis, and may be either a positive polarity (+) or a negative polarity (−).

Figure 6:
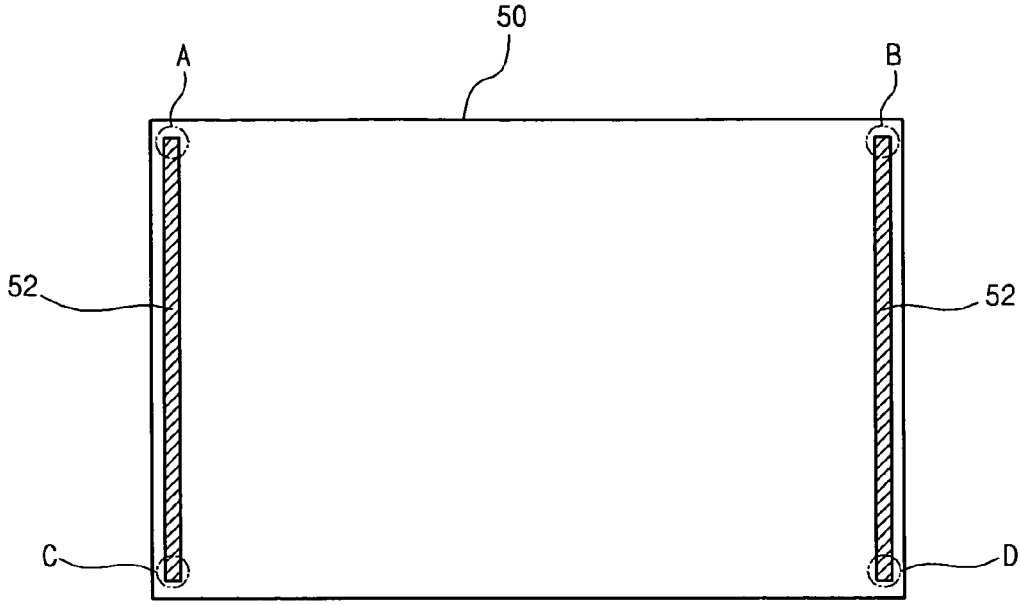
FIG. 6 is a diagram of a liquid crystal panel of FIG. 5.

FIG. 6 is a diagram of a liquid crystal panel of FIG. 5. In FIG. 6, at least one common voltage supply line 52 may be formed at a peripheral portion of the liquid crystal panel 50. The at least one common voltage supply line 52 may be connected to the plurality of common lines. A gate driver (not shown) may be connected to the liquid crystal panel 50 through a tape carrier package (TCP) method. When a gate driver is connected in this manner, the common voltage supply line 52 may be formed in the gate driver and/or the tape carrier package.

One end of the at least one common voltage supply line 52 (e.g., "A" and/or "B") may be supplied with the common voltage from a power supply (not shown). The common voltage may be transferred to a common electrode through the common voltage supply line 52 and a corresponding common line. Through the other end of the at least one common voltage supply line 52 (e.g., "C" and "D"), the inversion control circuit 60 may detect the common voltage at the liquid crystal display 50.

The inversion control circuit 60 may detect the common voltage of the liquid crystal display 50 and may output a driving change signal which may change a driving pattern that is used to drive the plurality of pixels in the liquid crystal panel. For example, when a ripple of a detected common voltage Vcom_f exceeds a predetermined level, the inversion control circuit 60 may output a driving change signal Vs_inv to a data driver 70 to change a pixel driving pattern. The data driver 70 may change a pixel driving pattern from a current driving pattern to a different driving pattern. The driving patterns may include dot-inversion driving patterns, or other pixel driving patterns.

Figure 7:
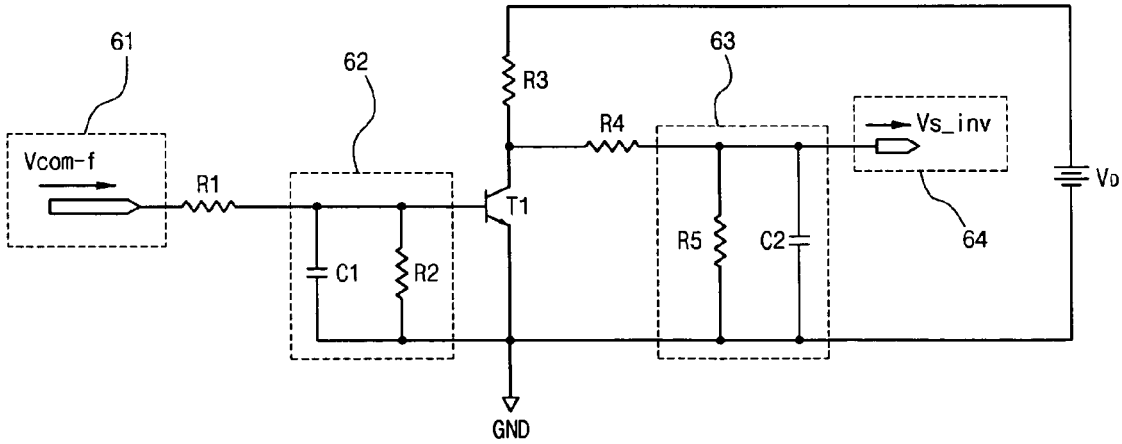
FIG. 7 is a circuit diagram of an inversion control circuit of FIG. 5.

FIG. 7 is a circuit diagram of an inversion circuit of FIG. 5. In FIG. 7, the inversion control circuit 60 may include an input terminal 61, a switch T1, a first RC (resistor-capacitor) parallel circuit 62, a second RC parallel circuit 63 and an output terminal 64. The switch T1 may be a switching transistor.

The input terminal 61 may receive the detected common voltage, Vcom_f. The detected common voltage Vcom_f may be supplied to the switch T1. Where the switch T1 is a switching transistor, the detected common voltage Vcom_f is supplied to a gate of the transistor.

Depending on the detected common voltage Vcom_μl the switch T1 may cause a driving change signal Vs_inv to be output by the inversion control circuit 60. When the detected common voltage Vcom_f exceeds a predetermined level, the switch T1 switches a driving voltage $V_D$ and outputs the driving change signal Vs_inv. The predetermined level may be a level corresponding to the sum of a reference common voltage and a predetermined voltage. The reference common voltage may be the common voltage supplied to the common electrode through the common voltage supply line 52. The predetermined voltage may be a voltage corresponding to a ripple of the detected common voltage Vcom_f that generally does not produce cross-talk.

The first RC parallel circuit 62 may control a switching time of the switch T1. The switching time may depend on a time constant (RC) of the first RC parallel circuit 62. The second RC parallel circuit 63 may substantially remove a noise of the driving change signal Vs_inv. The inversion control circuit 60 may also include resistors R1, R3, and R4. Resistor R1 may be between the input terminal 61 and the first RC parallel circuit 62. Resistors R3 and R4 may be between the switch T1, the driving voltage $V_D$, and the second RC parallel circuit 63.

The driving change signal Vs_inv output from the output terminal 64 may be input to the data driver 70. The data driver 70 may have a control pin to which the driving change signal Vs_inv is input. When the driving change signal Vs_inv is input to the data driver 70, the pixel driving pattern changes.

Figure 8:
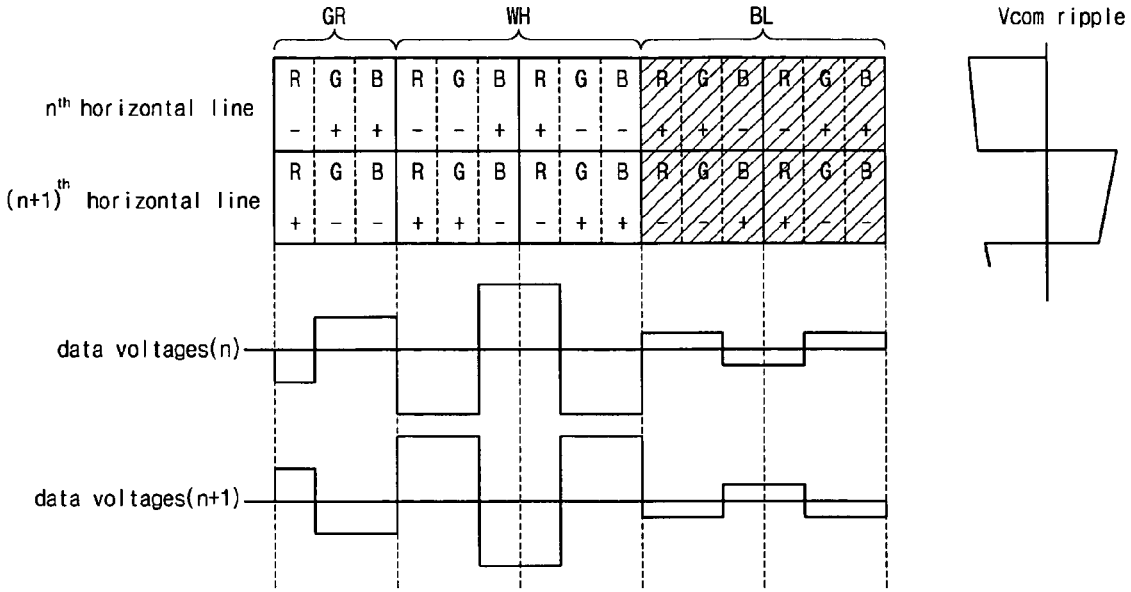
FIGS. 8 and 9 are diagrams of a polarity arrangement of pixels driven by the LCD device of FIG. 5.

For example, a LCD device may be configured to display a vertical stripe pattern of two white lines and two black lines, and gray. As shown in FIG. 8, the LCD device may be operated with a first driving pattern, such as a first horizontal two-dot inversion driving pattern. The first horizontal two-dot inversion driving pattern may drive the pixels such that a first pixel is driven with a first polarity, which may be positive or negative. A second and a third pixel may be driven with a second polarity that is opposite the first polarity. Thereafter, the pixels of groups of two adjacent pixels may be alternatingly driven with the first polarity and the second polarity, respectively. In each of white and black display regions, WH and BL, shown in FIG. 8, the polarities of the pixels are non-uniform. Furthermore, as shown in FIG. 8, the white display region WH has a data voltage with the largest amplitude, the black display region BL has a data voltage with the smallest amplitude, and the gray display region GR has a data voltage with an amplitude between that of the white and black display regions. Accordingly, a common voltage on each of an $n^{th}$ common line and a $(n+1)^{th}$ common line is shifted toward a lower or higher level, respectively. The shifting of the common voltage may generate a ripple of the common voltage that exceeds a predetermined level and generate a cross-talk in the gray display region GR.

An inversion control circuit 60 may detect the ripple of the common voltage Vcom_f. When the ripple exceeds the predetermined level, the inversion control circuit 60 outputs the driving change signal Vs_inv. When the driving change signal Vs_inv is input to the data driver 70, the pixel driving pattern is changed from the current driving pattern (e.g., first driving pattern) to a second driving pattern. The second driving pattern may be an alternate horizontal two-dot inversion driving pattern.

Figure 9:
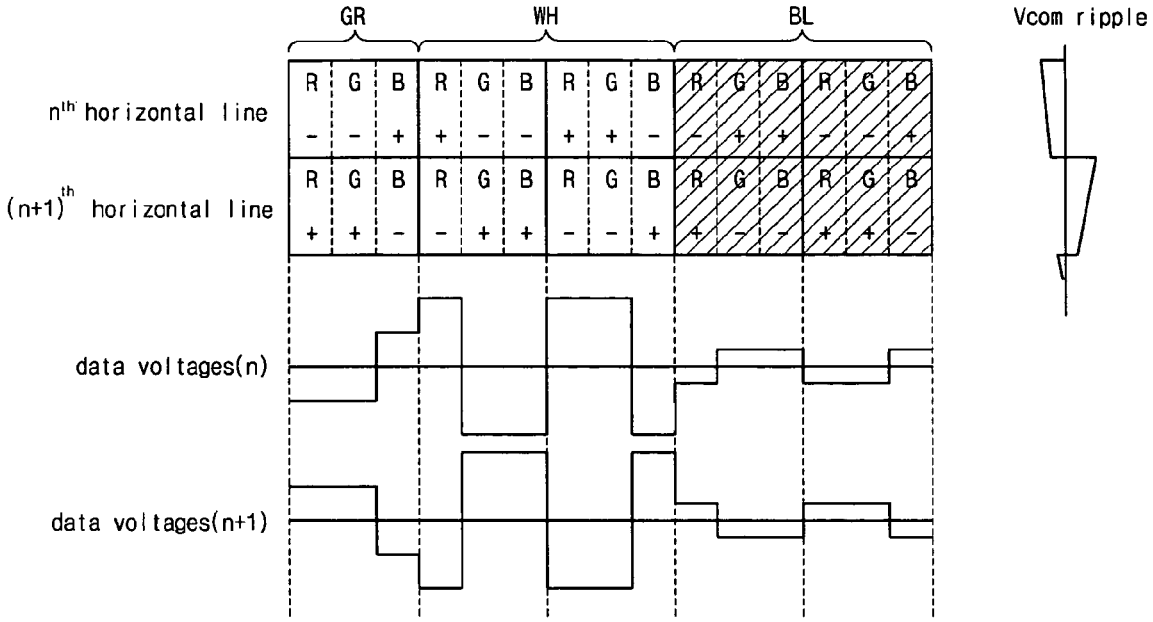

As shown in FIG. 9, the alternate horizontal two-dot inversion driving pattern may drive the pixels such that first and second adjacent pixels are driven with a first polarity, which may be positive or negative. Thereafter the pixels of alternating groups of two adjacent pixels are alternatingly driven with a second polarity, which is opposite the first polarity, and the first polarity, respectively. By changing the driving pattern, each of the white and black display regions WH and BL, have pixels with uniform polarity, and the ripple of the common voltage may be substantially offset. Accordingly, a cross-talk generally may not occur in the gray region GR.

The inversion control circuit 60 may continue to monitor the common voltage after the driving patterns are changed. If the inversion control circuit 60 detects a ripple in the common voltage that exceeds the predetermined level, the inversion control signal 60 may generate the driving change signal and the data driver 70 may change the driving pattern again. The data driver 70 may change the current driving pattern (e.g., second driving pattern) to the first driving pattern. Alternatively, the data driver may change the current driving pattern (e.g., second driving pattern) to a different driving pattern.

In some LCD devices, a ripple may also occur for the gate voltage since the gate lines may be coupled with the data lines. The inversion control circuit 60 may be configured to monitor the gate voltage from ends of the gate line and generate a driving change signal when a cross-talk occurs as a result of the gate voltage.

In some LCD devices, a common line may overlap a pixel electrode and form a storage capacitor. The common line forming the storage capacitor may also have a ripple in the common voltage. The inversion control circuit 60 may be configured to monitor the common voltage and generate a driving change signal when a ripple occurs in the common voltage.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A liquid crystal display device, comprising:

a liquid crystal panel comprises a plurality of pixels, a plurality of common lines along a first direction, a plurality of gate lines, where the plurality of common lines are supplied with a common voltage, wherein the plurality of pixels are driven according to a first pattern or a second pattern;

a gate driver connected to the liquid crystal panel through a tape carrier package to supply gate voltages to the plurality of gate lines;

at least one common voltage supply line in at least one of the gate driver and the tape carrier package and connected to the plurality of common lines;

a first region, and a plurality of second regions and third regions, each of the plurality of second and third regions comprising vertical multiple color lines, and wherein the first region is configured to have a voltage level with an amplitude that is between a voltage level amplitude of the second region and a voltage level amplitude of the third region, the plurality of second and third regions alternately arranged; and a driving circuit configured to measure a common voltage of the liquid crystal panel and generate a data driving signal that changes the driving pattern to one of the first pattern or second pattern in response to the measured common voltage.

2. The device of claim 1, wherein the driving circuit is configured to generate the driving signal when the measured common voltage exceeds a predetermined level.

3. The device of claim 1, wherein the first pattern comprises:

a first pixel driven by a first polarity; and a second and a third pixel driven by a second polarity, and thereafter the pixels of groups of two adjacent pixels are driven alternatingly by the first polarity and the second polarity.

4. The device of claim 1, wherein the second pattern comprises:

a first and a second pixel driven by a first polarity, and thereafter the pixels of alternating groups of two adjacent pixels are driven alternatingly by a second polarity and the first polarity, wherein the first and second pixel are adjacent to each other.

5. The device of claim 1, wherein the second region comprises a white display region and the third region comprises a black display region.

6. The device of claim 1, wherein the second region comprises a black display region and the third region comprises a white display region.

7. The device of claim 1, wherein the driving circuit comprises an inversion control circuit configured to output a driving signal when the measured common voltage exceeds a predetermined level.

8. The device of claim 7, wherein the inversion control circuit comprises an input terminal configured to receive a common voltage of the liquid crystal panel, and a switch coupled to the input terminal and an output terminal of the inversion control circuit.

9. The device of claim 8, wherein the inversion control circuit further comprises a first resistor-capacitor (RC) parallel circuit coupled to the input terminal and the switch, and a second RC parallel circuit coupled to the switch and the output terminal.

10. The device of claim 8, wherein the driving circuit further comprises a data driver that is configured to receive the driving signal and generate a plurality of data voltages corresponding to the first pattern or the second pattern.

11. The device of claim 1, wherein the liquid crystal panel further comprises at least one common voltage supply line, a first end of the at least one common voltage supply line coupled to a power supply and a second end of the at least one common voltage supply line coupled to the driving circuit.

* * * * *